US009221666B2

(12) United States Patent
Vandekerckhove et al.

(10) Patent No.: US 9,221,666 B2
(45) Date of Patent: Dec. 29, 2015

(54) DISPENSING APPLIANCE PROVIDED WITH A HINGED HOOD

(75) Inventors: Stijn Vandekerckhove, Brussels (BE); Daniel Peirsman, Brussels (BE)

(73) Assignee: Anheuser-Busch InBev S.A., Brussels (BE)

( * ) Notice: Subject to any disclaimer, the term of this patent is extended or adjusted under 35 U.S.C. 154(b) by 0 days.

(21) Appl. No.: 13/882,496

(22) PCT Filed: Oct. 28, 2011

(86) PCT No.: PCT/EP2011/069036

§ 371 (c)(1),
(2), (4) Date: May 2, 2013

(87) PCT Pub. No.: WO2012/056018

PCT Pub. Date: May 3, 2012

(65) Prior Publication Data

US 2013/0221034 A1 Aug. 29, 2013

(30) Foreign Application Priority Data

Oct. 29, 2010 (EP) ..... 10189466

(51) Int. Cl.
*B65D 83/00* (2006.01)
*B67D 1/08* (2006.01)
(Continued)

(52) U.S. Cl.
CPC ..... *B67D 1/0831* (2013.01); *B67D 1/0042* (2013.01); *B67D 1/0829* (2013.01); *B67D 1/0082* (2013.01); *B67D 1/0412* (2013.01)

(58) Field of Classification Search
CPC .. B67D 1/0829; B67D 1/0831; B67D 1/0839; B67D 1/0841; B67D 1/0842; B67D 1/0849; B67D 2001/0092; B67D 2001/0098; B67D 3/041; B67D 1/0042; B67D 1/0082; B67D 1/0412; B67D 1/06
USPC ..... 222/1, 145.5, 207, 209, 212, 394, 399, 222/400.7, 402.13, 402.18, 541.2, 564, 81, 222/82, 85
See application file for complete search history.

(56) References Cited

U.S. PATENT DOCUMENTS 3,374,927 A * 3/1968 Schmidt ..... 222/82
3,752,362 A * 8/1973 Risener ..... 222/85
(Continued)

FOREIGN PATENT DOCUMENTS

EP 0 026 077 4/1981
EP 1 647 499 4/2006
(Continued)

*Primary Examiner* — Frederick C Nicolas
*Assistant Examiner* — Bob Zadeh
(74) *Attorney, Agent, or Firm* — Levy & Grandinetti

(57) ABSTRACT

A dispensing appliance for receiving a container and dispensing a liquid is disclosed. The container has a body, a mouth, and a closure with an initially sealed first dispensing opening. The dispensing appliance has a container holding portion and a dispensing portion having a first dispensing tube with an engagement tip for engaging into dispensing opening to enter in fluid communication with the interior of the container. The dispensing portion is pivotally connected to the holding portion by a hinge to rotationally move from a first loading position. A second dispensing position allows dispensing the liquid. Moving the dispensing portion from a loading position to a dispensing position drives the engagement tip through the initially sealed dispensing opening of the closure. The engagement tip of the first dispensing tube is translated along a rectilinear path by rotation of the dispensing portion, to engage into the first dispensing opening.

17 Claims, 5 Drawing Sheets

(51) Int. Cl.
*B67D 1/00* (2006.01)
*B67D 1/04* (2006.01)

(56) References Cited

U.S. PATENT DOCUMENTS

| | | | | |
|---|---|---|---|---|
| 5,240,144 | A * | 8/1993 | Feldman | 222/82 |
| 5,251,787 | A | 10/1993 | Simson | |
| 5,499,758 | A | 3/1996 | McCann et al. | |
| 6,454,131 | B1 | 9/2002 | Van Der Meer et al. | |
| 2003/0071067 | A1 * | 4/2003 | Sluijter | 222/183 |
| 2009/0261129 | A1 * | 10/2009 | Vitantonio et al. | 222/394 |

FOREIGN PATENT DOCUMENTS

| | | |
|---|---|---|
| EP | 2 405 164 | 7/2010 |
| FR | 2 602 222 | 2/1988 |
| GB | 2 202 836 | 10/1988 |
| GB | 2 237 844 | 11/1989 |
| GB | 2 299 806 | 3/1995 |
| WO | WO9015774 | 12/1990 |
| WO | WO 2008/129018 | 10/2008 |
| WO | WO 2009/090223 | 7/2009 |
| WO | WO 2009/090224 | 7/2009 |
| WO | WO 2009/090225 | 7/2009 |
| WO | WO 2010/055057 | 5/2010 |

* cited by examiner

DISPENSING APPLIANCE PROVIDED WITH A HINGED HOOD

This Application is the U.S. National Phase of International Application Number PCT/EP2011/069036 filed on Oct. 28, 2011, which claims priority to European Application Number 10189466.5 filed on Oct. 29, 2010.

TECHNICAL FIELD

The present invention relates to a dispensing appliance as well as an assembly of a container containing a fluid and a dispensing appliance, wherein the connections of the appliance tubing to the container is made easily and reliably. The assembly of the present invention is particularly suitable for dispensing beverages, such as wine, and more particularly carbonated beverages such as beers and sodas.

BACKGROUND OF THE INVENTION

Dispensing containers containing a liquid such as a beverage may require to be mounted into a dispensing appliance for dispensing the liquid contained therein. The dispensing appliance comprises at least one dispensing tube bringing in fluid communication the volume of the container containing the liquid with ambient. This dispensing duct is usually provided with a valve for controlling the flow of liquid out of the container. In order to drive the flow of liquid out of the container, a dispensing appliance usually also comprises means for creating a pressure difference between the interior of the container and ambient to drive the liquid out of the container. Said means may be simply gravity driven, by positioning the inlet of the dispensing duct below the level of liquid like in old oak barrels for wine or in soap dispensers in public washrooms, but more advantageously, they comprise either means for increasing the pressure inside the container or, alternatively, decreasing the pressure outside the container, such as with a pump. If the pressure is being increased outside the container, such dispensing system is referred to herein as a "pressure dispensing" system, whilst a "vacuum dispensing" system refers to systems where the pressure inside the container is decreased. A pump may be used in both pressure and vacuum dispensing systems. For pressure dispensing systems, however, other means can be used such as pressurized gas stored in a pressure cartridge and/or adsorbed on a carrier. Said means for storing pressurized gas may be provided either in the container or in the appliance. If a source of pressurized gas external to the container is used, the dispensing appliance shall require at least a second, gas tube to be connected to a corresponding aperture in the closure or container body to bring said source in fluid communication with the interior of the container.

The gas connection may serve either to inject pressurized gas into the container to drive the dispensing of liquid ("pressure dispensing" systems), or to allow air into the container to fill the volume of dispensed liquid such as to maintain the pressure relatively constant in the container ("vacuum dispensing" systems). The container may comprise a single wall (although the wall can be a laminate) or may comprise several detachable layers, such as in bag-in-containers and bladder-in-containers. Bag-in-containers, also referred to as bag-in-bottles or bag-in-boxes depending on the geometry of the outer vessel, all terms considered herein as being comprised within the meaning of the term bag-in-container, are a family of liquid dispensing packaging consisting of an outer container comprising an opening to the atmosphere—the mouth—and which contains a collapsible inner hag joined to said container and opening to the atmosphere at the region of said mouth. The liquid is contained in the inner bag. The system must comprise at least one vent fluidly connecting the atmosphere to the region between the inner bag and the outer container in order to control the pressure in said region to squeeze the inner bag and thus dispense the liquid contained therein (cf. e.g., WO2008/129018 and GB8925324). Alternatively, in bladder-in-containers, the liquid is contained in the outer container and the inner bag, generally called a bladder, is either inflated to drive the flow of liquid out of the container, or simply put in fluid connection with atmospheric, in order to balance the pressure inside the container (cf. WO9015774, EP1647499, WO2010055057, U.S. Pat. No. 5,499,758, GB9504284, FR2602222, GB8806378). The advantage of bag-in-containers and bladder-in-containers over single wall containers is that the liquid is never in contact with an external gas. The present invention applies to any type of container provided with a closure comprising at least one aperture and is particularly suitable for pressure driven systems, more particularly for bag-in-containers and bladder-in-containers.

Of course, the connection of each tube with each corresponding aperture can be performed individually and once completed the container connected to all necessary tubing for the dispensing of the liquid contained therein can be positioned into the loading portion of the dispensing appliance. An example of such an assembly of a container and a dispensing appliance is given in WO90/15774, wherein the container is a bladder-in-container. In WO90/15774, a bladder and dispensing stem are provided in a dispensing end of the appliance which acts as a closure and can be fixed to the mouth of the container via a thread. The bladder and stem are therefore first introduced into and fixed to the container via said dispensing end, and thereafter the dispensing end and container are positioned in the housing of the appliance. A similar system can be found in U.S. Pat. No. 5,251,787 with a bag-in-container, wherein a dispensing end of the appliance comprises a dispensing stem to be introduced into the bag containing the liquid. Applying a dispensing end of a dispensing appliance with a stem into a container is quite cumbersome and has the great drawback that the container must be opened before mounting on the appliance. This contact of the liquid with ambient may be critical for the quality of some liquids.

For comfort of use, it is preferred that the container may be mounted onto the dispensing appliance in as few steps as possible, and for sensitive liquids, avoiding any contact between the liquid contained in the container with ambient. The latter can be achieved by providing the dispensing tube and any additional tubing, such as agas connection, with puncturing means suitable for breaking open a sealed opening. To reduce the number of steps required to mount the container onto the dispensing appliance, one could imagine that the container may be mounted onto the holding portion of an appliance and the dispensing end thereof simply applied on against the closure, with the aim of bringing the interior of the container in fluid communication with a dispensing tube and a gas connection. For obvious reasons, the at least one aperture in the closure is generally sealed prior to use and the sealed aperture must then be broken open to introduce the corresponding tubing in the thus unsealed aperture. Moreover, the interface between the appliance tubing and corresponding apertures, once engaged into one another, must be gas tight for pressure and most vacuum dispensing systems to allow pressure to build up. For these reasons, the introduction of a tube may require a substantial force, which is duplicated with each additional tube to be engaged into a corresponding aperture, so that the more tubes to be engaged, the higher will be the force required to make the connections.

U.S. Pat. No. 6,454,131 discloses a semi automated connecting system for a dispensing appliance associated with a bag-in-container. A first connection (18) of a pump (19) to the space (17) between inner and outer layers of the containers must first be performed individually. Then the tip of a right angle curved dispensing tube (34) is laid onto the sealing membrane of the dispensing aperture of the container. Upon closing the lid (4) by a rotational movement about hinges, and by pressurizing the space (17) the tip of the dispensing tube (34) is forced through the dispending aperture. Although the torque applied by closing the lid (4) by rotation about hinges eases the application of the force required to insert the dispensing tube through the container's aperture, this system still requires multiple steps for connecting each individual tubing of the appliance to the container, before the appliance can be closed into dispensing position.

If in the appliance disclosed in U.S. Pat. No. 6,454,131 the dispensing tube and the gas tube must be positioned prior to closing the cover (4) and only thereafter can one profit of the torque provided by the rotation thereof about the hinges to force the tip through the aperture, it is because a gas tight connection cannot be obtained if the tip of a tube follows the circular trajectory of the cover do penetrate into a straight channel like aperture. The obvious alternative is of course to translate the cover along a rectilinear direction to push any tube straight through the apertures. This solution however, is not satisfactory because the force required to engage all tubing into the corresponding apertures can be of the order of 100 to 200 N (corresponding to a weight of 10-20 kg) to be applied by the end user. This cannot be considered a user friendly system.

The present invention solves the problem of providing an appliance capable of engaging all necessary tubing into the corresponding apertures of a container in a single movement requiring little force, thus yielding a comfort of use to the user never reached to date. These and other objects of the invention are presented hereinbelow.

SUMMARY OF THE INVENTION

The present invention is defined in the appended independent claims. Preferred embodiments are defined in the dependent claims. In particular, the present invention concerns a dispensing appliance suitable for receiving a container and for dispensing a liquid contained in said container, wherein said container comprises a body, a mouth, and a closure provided with at least an initially sealed first, dispensing opening, said dispensing appliance comprising:

(a) a holding portion comprising means for holding the container, and (b) a dispensing portion comprising a first dispensing tube with an engagement tip suitable for engaging into said initially sealed dispensing opening of the closure, to enter in fluid communication with the interior of the container.

said dispensing portion being pivotally connected to the holding portion by at least one hinge to rotationally move from a first, loading position, allowing the loading of the container onto the appliance, and a second, dispensing position, allowing the dispensing of the liquid contained in the container, and wherein the moving of the dispensing portion from its first; loading position to its second, dispensing position drives the engagement tip of the first dispensing tube through the initially sealed dispensing opening of the closure.

characterized in that, the engagement tip of the first, dispensing tube is translated along a rectilinear path by the rotation of the dispensing portion about the hinge, to snugly engage into the first, dispensing opening.

It is preferred that the dispensing appliance be suitable for a pressure dispensing system and that the dispensing portion further comprises a second, gas tube suitable for engaging into a second opening of the closure along a rectilinear translation path upon rotation of the dispensing portion about the hinge, to smoothly engage into said second, gas opening, to bring in fluid communication the interior of the container with a source of pressurized gas, a A valve is preferably provided in the first, dispensing tube for controlling the flow of liquid therethrough.

The rectilinear translation of the dispensing and any additional tubes can best be controlled if the dispensing tube (10A), and any other tubing, is provided on a shuttle mounted on at least one straight guiding means such that the shuttle may travel in the direction defined by said guiding means upon rotating the dispensing portion about a hinge. The guiding means may consist of at least one rail, said at least one rail being either fixed with respect to the holding portion and the shuttle is movingly mounted thereon such as to be able to slide or roll along the rail or, alternatively, the shuttle may be fixed to a portion of said at least one rail which can slide with respect to the holding portion or is telescopic.

The rectilinear translation of the dispensing and any additional tubes can be imparted in different ways by the rotation of the hinged dispensing portion. In particular, the dispensing portion may comprise pushing means to push the tip of the at least first, dispensing tube along a rectilinear path as the dispensing portion is moved into its second, dispensing position by rotation about a hinge. Such pushing means may consist of a contact surface provided on one face of the dispensing portion, said surface having a geometry suitable for contacting said shuttle along substantially the whole rotation of the dispensing portion from its first, loading position to its second, dispensing position and thus defining a linear translation of the required magnitude to permit the engagement tip of the dispensing tube and any other tubing to engage deeply enough into the corresponding apertures of the closure Alternatively, the pushing means may consist of at least one rectilinear pushing rod fixed to the dispensing portion by its two ends to two fixing points, the first fixing point allowing only rotation of a first end of said rod (34) about an axis parallel to the axis of hinge (30) and the second fixing point comprising an elongated, preferably curved slot allowing the translation of the second end of the rod along the length of the slot.

Regardless of the means for transforming the rotational movement of the dispensing portion into a rectilinear movement of the tubing, it is preferred that the dispensing tube and, optionally, any other tubing, is encased in a cartridge, with a first tip of the tubes protruding out of a first side of the cartridge to face the corresponding opening of the closure it is to be engaged into, and the second end out of a second side of the cartridge with an orientation suitable for dispensing a liquid out of the container, generally substantially vertically facing downwards. The first tip of the dispensing tube and, optionally, of any other tubing may require to be suitable for breaking open the seal of an aperture provided in the closure of a container. This system facilitates the change of dispensing tube each time new container is mounted onto the appliance; this change may be required for hygienic reasons. The cartridge may then be easily fixed to the shuttle by means of a latch.

The present invention also concerns an assembly of a dispensing appliance as defined above and a container, wherein the container comprises a body, a mouth, and a closure provided with at least an initially sealed, first, dispensing opening.

The present invention allows to simultaneously profit, on the one hand, of the torque provided by rotation of the dispensing portion of the appliance about a hinge and, on the other hand, of the rectilinear translation of the tubing for engaging the corresponding apertures. The terms "opening" and "aperture" are used herein as synonyms unless otherwise defined.

BRIEF DESCRIPTION OF THE FIGURES

For a fuller understanding of the nature of the present invention, reference is made to the following detailed description taken in conjunction with the accompanying drawings in which.

DETAILED DESCRIPTION OF THE INVENTION

Figure 1:
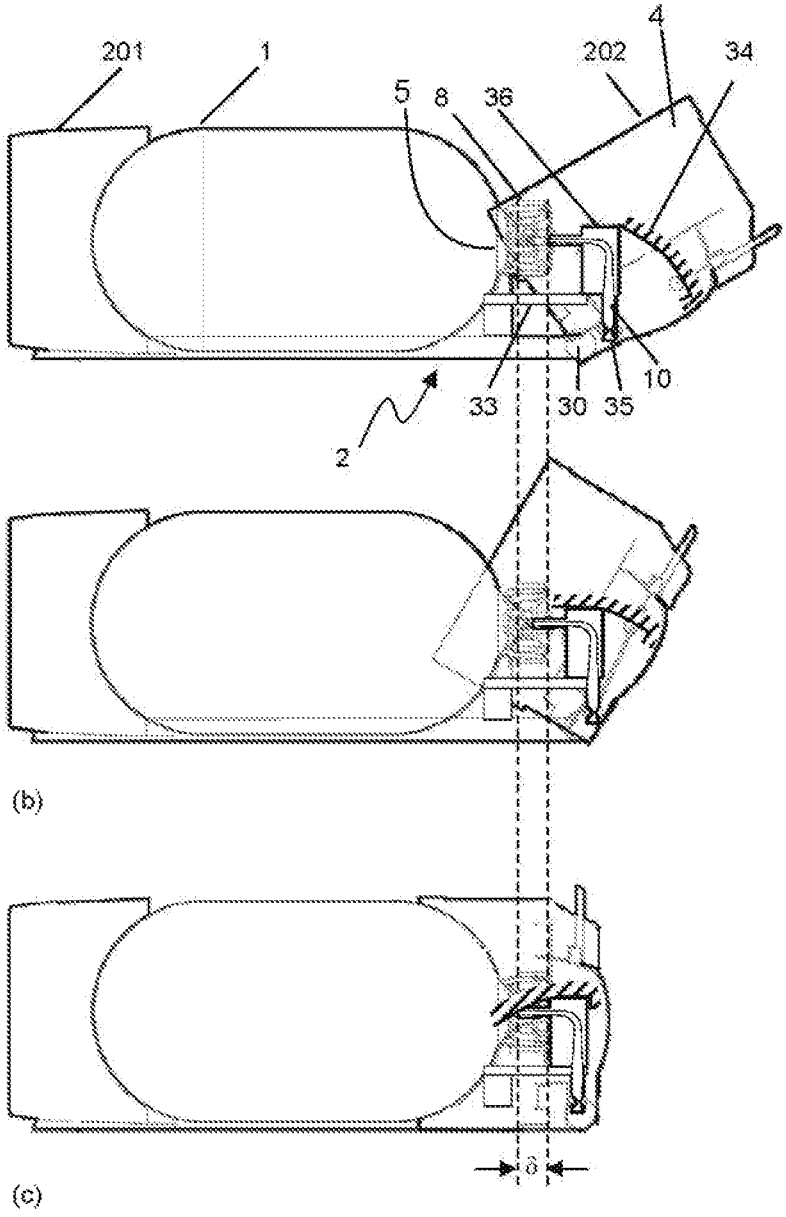
FIG. 1: shows a first embodiment of an assembly according to the present invention.

As can be seen in FIGS. 1 to 5, an appliance according to the present invention is suitable for receiving a container (1) and for dispensing a liquid contained in said container through a dispensing tube (10A) which fluidly communicates the volume of the container comprising the liquid with ambient. A container (1) suitable for being mounted onto said appliance shall comprise a body, a mouth (5), and a closure (8) provided with at least an initially sealed first, dispensing opening (10B) suitable for receiving said dispensing tube (10A). The dispensing appliance (2) comprises:

(a) a holding portion (201) comprising means (21) for holding the container, wherein the container is firmly held in position within the appliance, and (b) a dispensing portion (202) comprising a first dispensing tube (10A) with an engagement tip (8) suitable for engaging into said initially sealed dispensing opening (10B) of the closure (8), to enter in fluid communication with the interior of the container.

The dispensing portion (202) of the appliance according to the invention is pivotally connected to the holding portion (201) by at least one hinge (30) to rotationally move from a first, loading position, allowing the loading of the container (1) onto the appliance (2), to a second, dispensing position, allowing the dispensing of the liquid contained in the container. If there are more than one hinge (30), they may all define a single axis of rotation to define a circular path between the first and second positions or, alternatively, they can define two or more distinct, but parallel axes of rotation thus defining a non circular path, such as for example an elliptic path. In the Figures, for sake of simplicity, a single axis of rotation is represented, imparting to the dispensing portion a circular path between the first and second positions. It is important that a rotational movement is defined by the closing of the dispensing portion (202) in order to yield a torque effect and to reduce the force required to be applied by the end user to force the tip of the dispensing tube (10A) into the corresponding dispensing aperture (10B) in the closure (8) of the container. The outer shape of the holding and dispensing portions (201, 202) of the appliance (2) is of course not restricted in any way by the present inventon. For sake of simplicity, the appliances illustrated in the Figures have a substantially cylindrical shape, but any other shape can be imagined as long as the functions of each portion can be fulfilled. The dispensing portion (202) preferably defines with the holding portion (201) the outer shell of the appliance (2).

The rotational moving of the dispensing portion (202) from its first; loading position to its second, dispensing position must drive the engagement tip of the first dispensing tube (10A) through the initially sealed dispensing opening (10B) of the closure (8), to profit of the leverage effect yielded by the torque. In order to ensure an accurate engagement of the dispensing tube (10A) into the corresponding opening (10B), the engagement tip of the first, dispensing tube (10A) must be translated along a rectilinear path, driven by the rotation of the dispensing portion (202) about the hinge (30). With an appliance according to the present invention, the advantage in terms of torque offered by a rotating movement of the dispensing portion (202) is combined with the accurate and deep engagement of the tip of the dispensing tube (10A) into the dispensing opening (10B) offered by a rectilinear translation path of said tip. A rotational movement alone does not offer the accuracy required by pressurized beverage dispensing assemblies for the engagement of a tube into an aperture of the closure, and a rectilinear movement alone requires too much force to be applied by the end user for the level of comfort demanded by the public.

The appliance of the present invention is particularly suitable for use with pressure dispensing containers, requiring the pressure inside the container to be raised to drive the flow of liquid out of the container. In some cases, the container comprises means (29) for storing pressurized gas inside the container, such as in a pressure cartridge or adsorbed on a solid support. In such cases, no additional tubing is required. If the source of pressurized gas (29) is outside the container, however, then a second, gas tube (15A) is needed to bring said source of pressurized gas into fluid communication with the interior of the container through a second opening (158) in the closure. Unlike the appliance disclosed in U.S. Pat. No. 6,454,131 where the second, gas tube is separately engaged into an opening located near the bottom of the body of the keg whilst the dispensing tube is engaged into an opening in the closure, it is preferred herein to have the gas and dispensing openings (15B, 10B) all provided in the closure, in order to simultaneously engage all tubing into the container with a single move.

Consequently in a preferred embodiment the dispensing portion (202) further comprises a second, gas tube (15A) suitable for engaging into a second opening (15B) of the closure (8) along a rectilinear translation path upon rotation of the dispensing portion (202) about the hinge (30), to smoothly engage into said second, gas opening (15B), to bring in fluid communication the interior of the container with a source of pressurized gas (29).

Especially for pressure dispensing systems, but also useful for vacuum and gravity dispensing systems, it is preferred that the first, dispensing tube (10A) comprises a valve (35) for controlling the flow of liquid therethrough.

Figure 2:
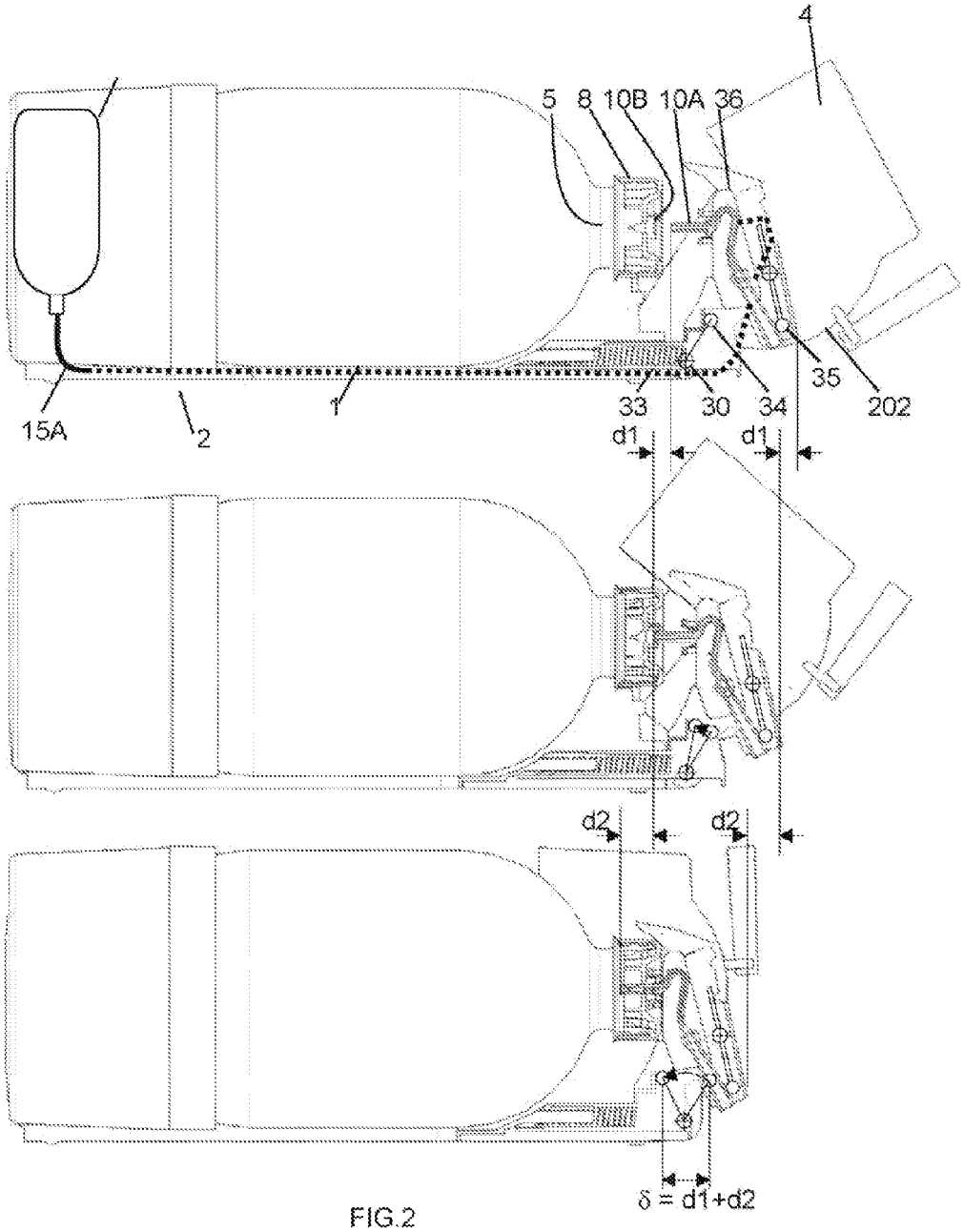
FIG. 2: shows a second embodiment of an assembly according to the present invention.
Figure 3:
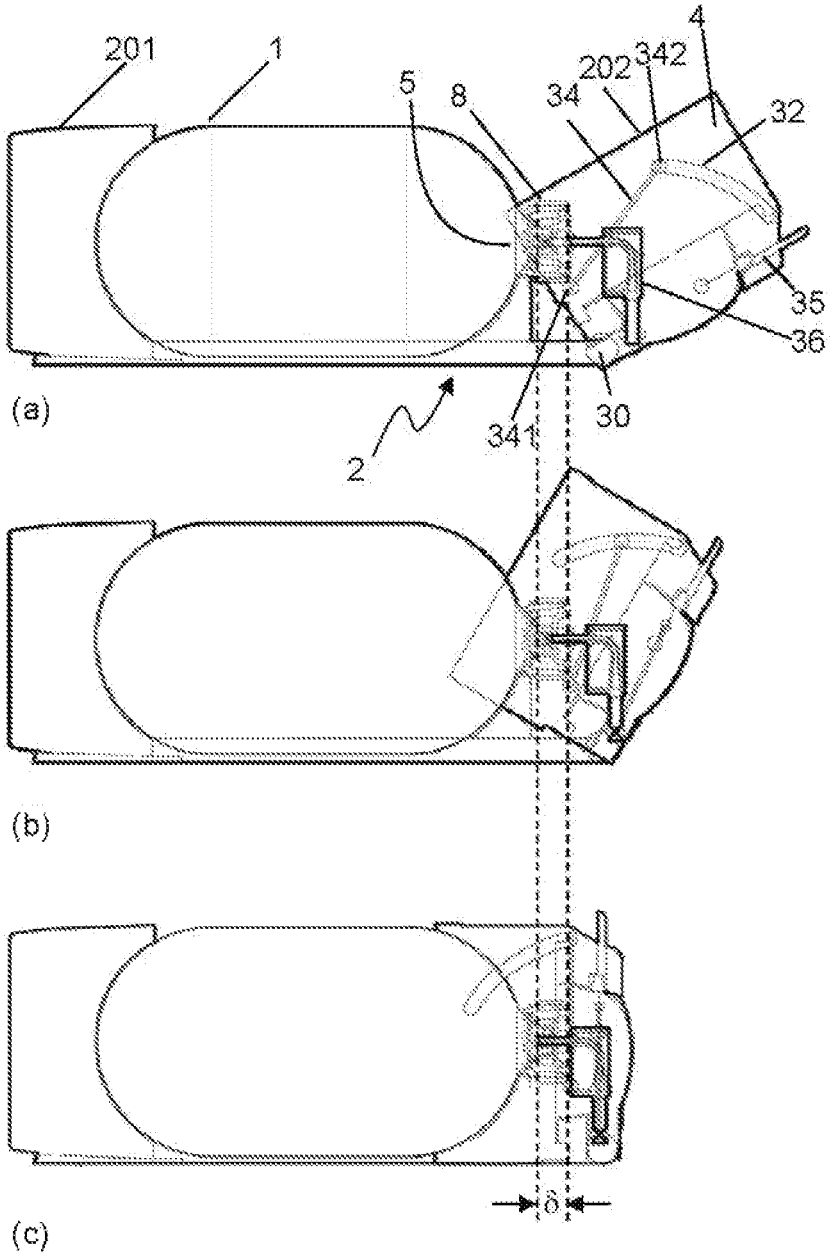
FIG. 3: shows a third embodiment of an assembly according to the present invention.
Figure 4:
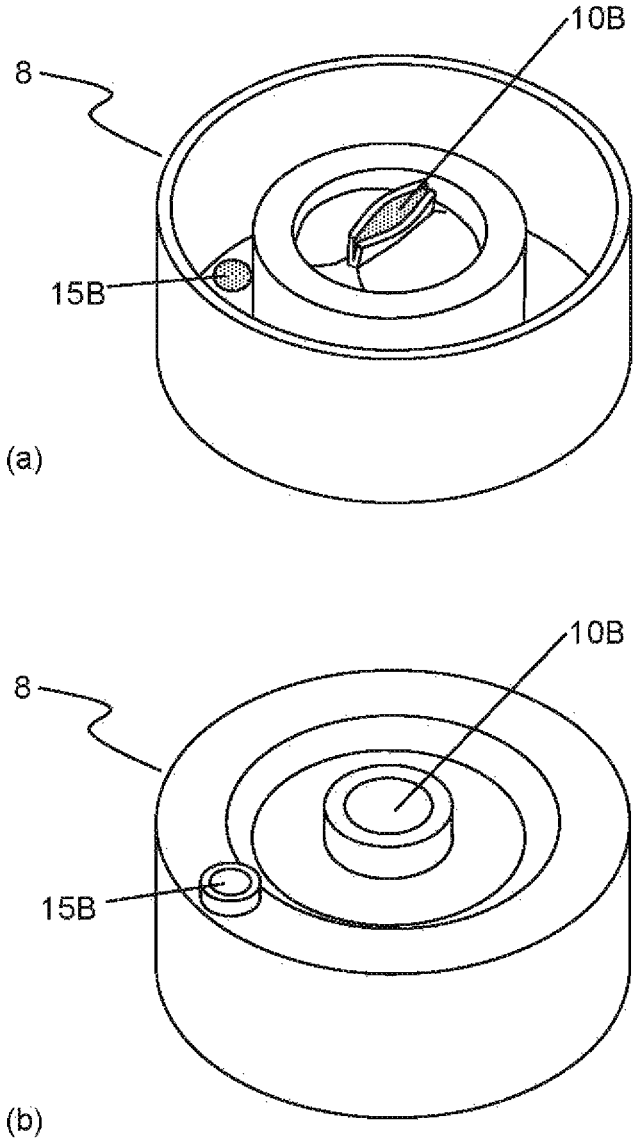
FIG. 4: shows an example of closure suitable for the assembly of the present invention.
Figure 5:
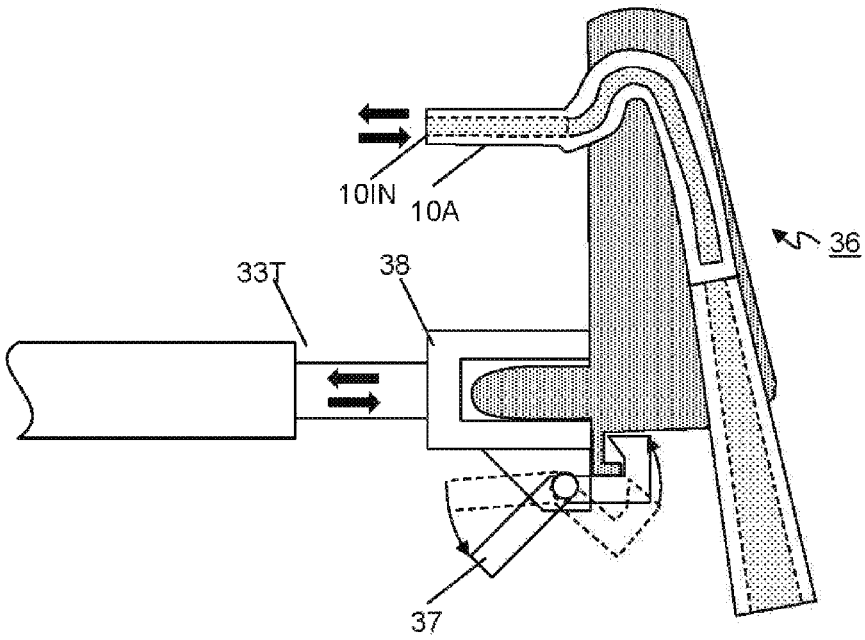
FIG. 5: shows a cartridge coupled to a shuttle by means of a latch and mounted on a telescopic rail.

The hinge (30) is preferably located at the outer perimeter of the dispensing portion (202) in order to increase the torque effect and and thus reduce the force required to engage the dispensing tube (10A) and any other tubing (15A) into the corresponding openings (10B, 15B) of the closure. If the force required to engage the tubing is not excessive, however, it is possible to locate the hinges (30) elsewhere, such as for for example defining an axis of rotation passing by the centre of the cross-section of the dispensing portion (202) (e.g., if the dispensing portion is substantially cylindrical as represented in FIGS. 1 to 3, the axis of rotation defined by the hinges could be a diameter of the circular cross-section). Locating the hinge (30) at the perimeter of the dispensing section (202) is, however, preferred, because it yields a higher torque effect and it provides more room for loading the container into the holding portion (201).

In order to ensure a rectilinear translation of the tubing upon dosing the dispensing tube upon hinge (30), in a preferred embodiment, the dispensing tube (10A) and any other tubing is provided on a shuttle (38) mounted on a rectilinear guiding means (33) such that the shuttle can travel back and forth along the direction defined by said guiding means, which direction is of course parallel to the axis of the dispensing opening (10B) and any other corresponding openings (15B) provided in the closure (8). The guiding means (33) can be at least one straight guiding rail (33), or a channel. It preferably consists of at least one rail. The shuttle mobility along the direction defined by the guiding means can be achieved as follows. The at least one rail (33), or any other guiding means, may be fixed with respect to the holding portion (201) and the shuttle is movingly mounted thereon such as to be able to slide or roll along the rail. Alternatively, the shuffle may be fixed to a portion of at least one rail (33), said portion being able to move with respect to the holding portion (201), either by being slidingly mounted thereon, e.g., with rollers like in a tray in a dishwasher or by providing a telescopic rail (33T).

There are several ways to transform a rotational movement into a rectilinear translation. For example, it is known in reciprocating engines to transform a rectilinear movement of a piston into a rotational movement of a camshaft, and inversely for generators. This system, can be implemented in a dispensing appliance according to the present invention by providing a shaft, straight or curved, pivotally fixed at one end to the dispensing portion (202) and at the other end to the shuttle.

Alternatively, the tubing (10A, 15A), preferably located in a shuttle mounted on guiding means (33), can be pushed in the direction defined by the guiding means (33) by pushing means (34) provided on the dispensing portion (202) as the latter is moved into its second, dispensing position by rotation about hinge (30). The pushing means (34) may simply be a surface provided on one face of the dispensing portion (202), said surface having a geometry suitable for contacting said shuttle along substantially the whole rotation of the dispensing portion (202) from its first, loading position to its second, dispensing position and to thus define a linear translation of the required magnitude to permit the engagement tip of the dispensing tube (10A) and any other tubing (15A) to engage deeply enough into the corresponding apertures (10B, 15B) of the closure. The geometry of such contact means (34) may generally define a curved surface as schematically illustrated in FIG. 1. Alternatively, as illustrated in FIG. 2, it is the surface of the shuttle that is to contact the contact means (34) which are designed such as to always contact the contact means (34). In the embodiment illustrated in FIG. 2, the contact means (34) are located very close to the hinge (30) and the height variation of the contact means along the rotation is reduced, since it is proportional to the radius of the rotation about the hinge.

Alternatively, the pushing means (34) may consist of at least one guiding structure, such as in the shape of a rod (34) suitable for mechanically contacting the shuttle on which is mounted the first, dispensing tube (10A), and any other tubing (15A), if the guiding rod (34) is rectilinear, as illustrated in FIG. 3, it may be fixed to the dispensing portion (202) by its two ends to two fixing points, the first fixing point allowing only rotation of a first end of the rod about an axis parallel to the axis of hinge (30) and the second fixing point comprising an elongated, preferably curved slot (32) allowing translation of the fixing point along the length of said slot.

For hygienic reasons, it is preferred that the dispensing tube (10A) be changed with any new container. To avoid the drawback of prior art appliances requiring the individual connection of one or more tubes to the container and then mounting the container into the appliance and positioning each tube individually into the appropriate lodging in the appliance, it is preferred that the dispensing tube (10A) be encased in a cartridge (36), with a first tip of the tube protruding out of a first side of the cartridge to face, when in position, the corresponding aperture (10B) it must engage into, and the second end out of a second side of the cartridge to allow dispensing of the liquid. Preferably, the dispensing tube is curved in the cartridge such that the outlet end of the dispensing tube is oriented downwards, substantially vertically, to allow pouring of the liquid into a glass or any appropriate vessel. The curved pattern of the tube inside the cartridge depends on the axis of the dispensing opening (108) when in use. If the dispensing opening (108) is coaxial with the axis of the container and If the container is to be laid down horizontally as illustrated in FIGS. 1 to 3, then the two ends should be substantially normal to each other forming an "L." If the container to be positioned vertically, i.e., with the closure facing up, then the dispensing tube (10A) shall make a reversed U-curve—or define two bends—in the cartridge. The cartridge (36) can be fixed to the shuttle by means of a latch (37), as is commonly found e.g., in ink jet printers for fixing ink cartridges. The cartridge may comprise other tubes to be engaged into corresponding openings, e.g., in case different components must be mixed before dispensing, or a gas tube (15B). It is not, however, necessary to change the gas tube (15B) as often as a dispensing tube (10A), so it can be advantageous for economical reasons, to provide the gas tube on the shuttle separately from the cartridge (36).

The engagement tip (10IN) of the dispensing tube (10A) protruding out of a first side of the cartridge should be suitable for breaking open the seal of an aperture provided in the closure (8) of a container (1) and to engage thereinto. The dispensing aperture (10B) and any other aperture (15B) can be sealed by a membrane which must be broken to unseal (=one shot seal) or by a resilient valve which can be open by engaging the tip of a tube, and sealed again upon withdrawal of said tube. Examples of closures suitable for use in the present invention are disclosed in WO2009/090223, WO2009/090224, WO2009/090225, and in EP application number 10168970.1. The closure (8) disclosed in FIG. 4 corresponds to the latter application and with its first, dispensing opening (10B) and its second, gas opening (15B), it is suitable for closing the mouth of a bag-in-container. The sealing of the first, dispensing, opening (10B) is ensured by a resilient valve, visible in FIG. 4(*a*).

The dispensing appliance (2) of the present invention can advantageously be assembled with a container (1) for dispensing the liquid contained therein. The container shall comprise a body, a mouth, and a closure (8) provided with at least an initially sealed, first, dispensing opening (10B). In a preferred embodiment the assembly defines a pressure dispensing system and the dispensing appliance comprises a second, gas tube (15A) to be engaged into a second, gas opening (15B) in the closure for bringing in fluid communication the interior of the container with a source of pressurized gas (29). In a preferred embodiment, the container (1) is a bag-in-container with the liquid contained in an inner, flexible bag in fluid communication with the first, dispensing opening (10B) and a space or a delaminatable interface between the inner bag and the outer layer of the container, in fluid communication with the second, gas opening (15B) of the closure (8).

An assembly according to the present invention may be placed in a fridge to bring down the temperature of a beverage contained therein, e.g., beer, to its serving temperature, and the beer can be served with the appliance still in the fridge, with an open door and the outlet of the dispensing tube (10A) and a valve (34) facing out of the fridge. The source of pressurized gas (29) may be a pump, which power can be supplied either with a battery, a small solar cell, or by some connection to the net outside the fridge (e.g., at the location of the fridge light). If no such connection or solar cell is available, or if no battery is desired in a fridge, the pressurized gas may be stored either in a pressurized cartridge or adsorbed onto a solid support. This way, no electrical power is required to pressurize and activate the dispensing assembly. It is also possible to provide the dispensing assembly (2) with a cooling system so that it needs not be stored in a fridge, thus simplifying the supply of power thereto.

A dispensing appliance and a container as described above can be assembled by the following steps:

(a) providing a container (1) comprising a body, an opening closed by a closure (8), said closure comprising at least an initially sealed first, dispensing opening (108), (b) bringing a dispensing portion (202) of a dispensing appliance (2) into a loading position, suitable for loading the container into a holding portion (201) of said appliance;

(c) loading the container (1) into the holding portion (201) of the appliance with the at least one dispensing opening (108) facing towards the dispensing portion (202), (d) Moving the dispensing portion (202) by rotation about a hinge (30) into a dispensing position, wherein, (e) a first dispensing tube (10A) is provided in the dispensing portion (202), having a first, engagement tip oriented parallel to and coaxially with the at least one dispensing opening (10B), and (f) The rotation of the dispensing portion (202) about the hinge (30) to bring it into its dispensing position drives the rectilinear translation of the tip of the dispensing tube (10A) to break the seal of the at least first dispensing opening (10B) and to engage it thereinto.

This method can be applied to any container (1) and to any dispensing appliance (2) discussed above. In particular, if the assembly defines a pressure dispensing system, the closure (8) should comprise a second, gas opening (15B) oriented parallel to the first, dispensing opening, and the dispensing portion should be provided with a second, gas tube (15A) parallel to the first, dispensing tube (10A), such that the rotation of the dispensing portion (202) about the hinge (30) to bring it into its dispensing position drives the rectilinear translation of the tips of both the dispensing tube (10A) and the gas tube (15A) to engage into the corresponding dispensing and gas openings (10B, 15B).

The invention claimed is:

1. A dispensing appliance suitable for receiving a container and for dispensing a liquid contained in said container, wherein said container comprises a body, a mouth, and a closure provided with at least an initially sealed first dispensing opening, said dispensing appliance comprising:

(a) a holding portion comprising means for holding the container, and (b) a dispensing portion comprising a dispensing tube with an engagement tip suitable for engaging into said initially sealed dispensing opening of the closure, to enter in fluid communication with an interior of the container, and pushing means to push said engagement tip, said dispensing portion being pivotally connected to the holding portion by at least one hinge to rotationally move from a loading position, allowing a loading of the container onto said dispensing appliance, to a dispensing position, allowing the dispensing of the liquid contained in the container, and wherein the moving of the dispensing portion from the loading position to the dispensing position drives the engagement tip of the dispensing tube through the initially sealed dispensing opening of the closure, wherein the engagement tip of the dispensing tube is translated along a rectilinear path by the rotation of the dispensing portion about the hinge to engage into the dispensing opening and is further pushed along said rectilinear path by the pushing means as the dispensing portion is moved into the dispensing position by said rotation about said hinge, wherein the pushing means consists of at least one rectilinear pushing rod fixed to the dispensing portion by a first end and by a second end of said rod, the first end being fixed such as to allow only rotation of said rod about an axis parallel to the axis of the hinge and the second end being engaged in an elongated slot allowing the translation of the second end of the rod along a length of the slot.

2. The dispensing appliance according to claim 1, wherein the dispensing portion further comprises a gas tube suitable for engaging into a gas opening of the closure along a rectilinear translation path upon rotation of the dispensing portion about the hinge, to engage into said gas opening, to bring in fluid communication the interior of the container with a source of pressurized gas.

3. The dispensing appliance according to claim 1, wherein the dispensing tube comprises a valve for controlling the flow of the liquid therethrough.

4. The dispensing appliance according to claim 3, wherein the dispensing tube is provided on a shuttle mounted on at least one straight guiding means such that the shuttle may travel in the direction defined by said guiding means upon rotating the dispensing portion about the hinge.

5. The dispensing appliance according to claim 4, wherein the guiding means is at least one rail, said at least one rail being either fixed with respect to the holding portion and the shuttle is movingly mounted thereon such as to be able to slide or roll along said at least one rail or, alternatively, the shuttle is fixed to a portion of said at least one rail which can slide with respect to the holding portion or is telescopic.

6. The dispensing appliance according to claim 4, wherein a gas tube is provided on said shuttle.

7. The dispensing appliance according to claim 1, wherein the dispensing tube, is encased in a cartridge, with the engagement tip of said dispensing tube protruding out of a first side of the cartridge to face, when in position, a corresponding aperture into which the engagement tip must engage, and an outlet end, opposite the engagement tip of said dispensing tube out of a second side of the cartridge such that the outlet end of the dispensing tube is oriented downwards, substantially vertically, and wherein the cartridge is fixed to the appliance by means of a latch.

8. An assembly of a dispensing appliance according to claim 1 and the container, wherein the container comprises the body, the mouth, and the closure provided with at least an initially sealed, dispensing opening.

9. The assembly according to claim 8 wherein the container is a pressure dispensing container and is preferably a bag-in-container, and wherein the closure comprises at least a first dispensing aperture and a second gas aperture for receiving a dispensing tube and a gas tube, respectively.

10. A method for loading the container containing the liquid into the dispensing appliance according to claim 1, said method comprising the following steps:

(a) providing the container comprising the body, an opening closed by the closure, said closure comprising at least the initially sealed dispensing opening, (b) moving the dispensing portion with respect to the holding portion of the dispensing appliance by rotation of the dispensing portion about the hinge connecting the dispensing portion to the holding portion into the loading position, (c) loading the container into the holding portion of the appliance with the at least one dispensing opening facing towards the dispensing portion, (d) moving the dispensing portion by rotation about the hinge into the dispensing position, wherein, (e) a first dispensing tube is provided in the dispensing portion, having the engagement tip oriented parallel to and coaxially with the at least one dispensing opening, said engagement tip further being pushable by the at least one rectilinear pushing rod also provided in said dispensing portion and fixed thereto by the first end and the second end of said rod, the first end being fixed such as to allow only rotation of said rod about an axis parallel to the axis of the hinge and the second end being engaged in an elongated slot allowing the translation of the second end of the rod along the length of the slot; and wherein (f) the rotation of the dispensing portion about the hinge to bring the dispensing portion into the dispensing position drives the rectilinear translation of the engagement tip of the dispensing tube while the pushing rod pushes said engagement tip along said rectilinear path to break the seal of the initially sealed dispensing opening and to push said engagement tip into engagement with said dispensing opening.

11. A method for using the container for dispensing the liquid with the dispensing appliance according to claim 1, which is suitable for receiving the container and for dispensing the liquid contained in said container, wherein said container comprises the body, the mouth, and the closure provided with the at least an initially sealed first dispensing opening, said method comprising:

(a) holding the container at the holding portion, and (b) dispensing from the dispensing portion comprising the first dispensing tube with the engagement tip suitable for engaging into said initially sealed dispensing opening of the closure, to enter in fluid communication with the interior of the container, said pushing means to push said engagement tip, said dispensing portion being pivotally connected to the holding portion by the at least one hinge to rotationally move from a loading position, allowing the loading of the container onto the appliance, and the dispensing position, allowing the dispensing of the liquid contained in the container, and wherein the moving of the dispensing portion from the loading position to the dispensing position drives the engagement tip of the first dispensing tube through the initially sealed dispensing opening of the closure, wherein the engagement tip of the dispensing tube is translated along the rectilinear path by the rotation of the dispensing portion about the hinge to engage into the dispensing opening, and is further pushed along said rectilinear path by the pushing means as the dispensing portion is moved into the dispensing position by said rotation about said hinge, wherein, the pushing means consist of the at least one rectilinear pushing rod fixed to the dispensing portion by the first end and the second end of said rod to said dispensing portion, the first end being fixed such as to allow only rotation of said rod about the axis parallel to the axis of the hinge and the second end being engaged in an elongated, preferably curved slot allowing the translation of the second end of the rod along the length of the slot.

12. The dispensing appliance according to claim 1, wherein the first dispensing tube comprises a valve for controlling the flow of liquid therethrough.

13. The dispensing appliance according to claim 1, wherein the dispensing tube is provided on a shuttle mounted on at least one straight guiding means such that the shuttle may travel in the direction defined by said guiding means upon rotating the dispensing portion about the hinge.

14. The dispensing appliance according to claim 1, wherein the guiding means is at least one rail, said at least one rail being either fixed with respect to the holding portion and the shuttle is movingly mounted thereon such as to be able to slide or roll along the rail or, alternatively, the shuttle is fixed to a portion of said at least one rail which can slide with respect to the holding portion or is telescopic.

15. The dispensing appliance according to claim 1, wherein the elongated slot is curved.

16. The dispensing appliance according to claim 1, wherein the dispensing tube is encased in a cartridge, with the engagement tip of said tube protruding out of a first side of the cartridge to face, when in position, a corresponding aperture into which the engagement tip must engage, and another tip of said tube out of a second side of the cartridge such that the outlet end of the dispensing tube is oriented downwards, substantially vertically, and wherein the cartridge is fixed to the appliance by means of a latch.

17. A dispensing appliance suitable for receiving a container and for dispensing a liquid contained in said container, wherein said container comprises a body, a mouth, and a closure provided with at least an initially sealed dispensing opening, said dispensing appliance comprising:

(a) a holding portion comprising means for holding the container, and (b) a dispensing portion comprising a dispensing tube with an engagement tip suitable for engaging into said initially sealed dispensing opening of the closure, to enter in fluid communication with an interior of the container, and pushing means to push said engagement tip;

said dispensing portion being pivotally connected to the holding portion by at least one hinge to rotationally move from a loading position, allowing the loading of the container onto said dispensing appliance, to a dispensing position, allowing the dispensing of the liquid contained in the container, and wherein the moving of the dispensing portion from the loading position to the dispensing position drives the engagement tip of the dispensing tube through the initially sealed dispensing opening of the closure, wherein, the engagement tip of the dispensing tube is translated along a rectilinear path by the rotation of the dispensing portion about the hinge to engage into the dispensing opening, and is further pushed along said rectilinear path by the pushing means as the dispensing portion is moved into the dispensing position by said rotation about said hinge, wherein the pushing means consist of a contact surface provided on one face of the dispensing portion, said surface and shuttle having a geometry suitable for the contact surface to contact said shuttle along substantially a whole rotation of the dispensing portion from the loading position to the dispensing position and thus defining a linear translation of a required magnitude to permit the engagement tip of the dispensing tube to engage deeply into a corresponding aperture of the closure.

* * * * *